US009643775B2

(12) United States Patent
Kraft

(10) Patent No.: US 9,643,775 B2
(45) Date of Patent: May 9, 2017

(54) STACKED COLLAPSIBLE CONTAINER

(71) Applicant: COMPACT CONTAINER SYSTEMS LLC, Boca Raton, FL (US)

(72) Inventor: Joshua J. Kraft, Tequesta, FL (US)

(73) Assignee: Compact Container Systems LLC, Boca Raton, FL (US)

( * ) Notice: Subject to any disclaimer, the term of this patent is extended or adjusted under 35 U.S.C. 154(b) by 48 days.

(21) Appl. No.: 14/829,275

(22) Filed: Aug. 18, 2015

(65) Prior Publication Data

US 2016/0083176 A1 Mar. 24, 2016

Related U.S. Application Data

(60) Provisional application No. 62/052,614, filed on Sep. 19, 2014.

(51) Int. Cl.
*B65D 88/52* (2006.01)

(52) U.S. Cl.
CPC ..... *B65D 88/522* (2013.01)

(58) Field of Classification Search
CPC .... B65D 88/52; B65D 88/522; B65D 88/524; B65D 88/526; B65D 88/528
USPC ..... 220/6, 7, 666, 4.28–4.34, 1.5, 1.6, 4.08, 220/9.2, 23.83, 23.86, 667
See application file for complete search history.

(56) References Cited

U.S. PATENT DOCUMENTS

| | | | | |
|---|---|---|---|---|
| 4,506,798 | A * | 3/1985 | Goutille | B65D 88/121 220/1.5 |
| 5,190,179 | A * | 3/1993 | Richter | B65D 90/008 220/1.5 |
| 7,984,819 | B1 | 7/2011 | Davis | |
| 2010/0025397 | A1* | 2/2010 | Krohn | B65D 88/12 220/6 |
| 2011/0062167 | A1* | 3/2011 | Colton | B65D 19/18 220/666 |
| 2014/0144907 | A1 | 5/2014 | Giesbers et al. | |
| 2014/0263306 | A1* | 9/2014 | Brennan, Jr. | B65D 7/26 220/6 |

FOREIGN PATENT DOCUMENTS

EP 2796388 A1 10/2014

OTHER PUBLICATIONS

PCT Application No. PCT/US2014/062092, International Search Report and Written Opinion dated Feb. 6, 2015, 7 pages.
U.S. Appl. No. 13/815,638, filed Mar. 13, 2013, 151 pages.

* cited by examiner

*Primary Examiner* — Robert J Hicks
*Assistant Examiner* — Kareen Thomas
(74) *Attorney, Agent, or Firm* — Lathrop & Gage L.L.P.

(57) ABSTRACT

The present invention discloses a novel apparatus and way for folding a shipping container in order to improve space utilization when in a folded condition. As a result of the container design, less vertical space is occupied in the folded condition thereby allowing an additional folded container to be stacked in an assembly of folded containers when compared to the prior art designs.

12 Claims, 11 Drawing Sheets

STACKED COLLAPSIBLE CONTAINER

CROSS-REFERENCE TO RELATED APPLICATIONS

This patent application claims priority to U.S. Patent Application Ser. No. 62/052,614 filed on Sep. 19, 2014 and is hereby incorporated in its entirety.

TECHNICAL FIELD

The present invention relates generally to a shipping container. More specifically the present invention relates to a foldable shipping container and the improved transport of shipping containers in a folded condition.

BACKGROUND OF THE INVENTION

The shipping industry uses large cargo containers to ship cargo from one location to another in domestic and global commerce. Such containers are designed to be conveniently moved from one mode of transport to another across the land by road or on rail or over the sea. Such containers are sometimes referred to as "intermodal shipping containers" or "Freight Containers." The use of such containers has essentially eliminated the need for manually transferring cargo from one vessel to another, or from one vehicle or railcar to another in the effort to deliver the cargo to its final destination.

Today, cargo containers are generally standardized by internationally recognized standards, and by national domestic standards with respect to dimensions and structure. Thus, the standard containers can be securely arranged in vertical stacks in side-by-side and end-to-end relationship with each other, and can be handled most effectively when transferring from one mode of transport to another regardless of their source or destination.

Often, these containers must be transported empty from one delivery point to the next location where cargo is available for shipment. Transport of empty containers costs the shipper money and erodes profits since transport of each such container incurs handling cost and occupies valuable space which could otherwise be used to ship a revenue producing container loaded with cargo. Additionally, the shipping of both loaded and empty containers creates problems such as how to arrange the lighter, empty containers and the heavier, loaded containers aboard ships in such a manner that the safety of the ships is not compromised. Beyond safety issues, the shipment of empty containers causes monetary losses for shippers, losses which result in either substantial financial impact on the shipper or increased charges to customers for the handling and transport of loaded containers. Similar cost disadvantages apply when shipping empty containers over road or by rail.

Long ago shippers recognized that significant economic savings in shipping could be realized if empty containers could be "folded" so as to occupy a substantially smaller space, so that less space need be sacrificed in the transporting of empty containers. Such an effort presently exists only for the "open frame" or flat rack type containers. To that end, the prior art proposed many foldable or nesting cargo containers of the enclosed types intended to reduce the space required for their shipment when empty. While such prior art foldable containers have been proposed, the market has not embraced the prior art containers as a substitute for the standard, non-foldable cargo containers due to these prior art foldable containers not meeting ISO standards and ISO certifications for being water proof.

One common shortcoming in most foldable container designs is that structural features are incorporated in them which render the designs nearly incompatible for use in combination with existing, standard cargo containers. Accordingly, if these cargo containers were to become a part of the norm, they could not be used with existing standard containers, making the cost of implementation of these designs impractical, if not prohibitive.

Another shortcoming of foldable containers of the prior art is the lack of structural designs which enable or facilitate the folding and un-folding of such containers in a simple and effective manner with commonly available equipment. While prior art containers can collapse and reduce the overall space required when the containers are not in use, these containers still occupy additional, unnecessary space.

SUMMARY

The present invention discloses a system for foldable shipping containers. More specifically, in an embodiment of the present invention a shipping container is provided that is capable of collapsing from an erect position to a storage position. The container is sized such that when the container is folded in the storage configuration, the container is significantly reduced in height compared to containers of the prior art. Furthermore, the present invention provides a way of stacking five folded containers in the space of one erect shipping container. The space saved by the ability to stack the containers in this arrangement provides savings in land storage as well as rail or ship transport. The weight of the five stacked containers is comparable to a single container holding its maximum payload.

In an alternate embodiment of the present invention, a vertically-stacked assembly of folded shipping containers is provided. More specifically, each container of the assembly comprises a roof assembly with a roof panel having a left and right skirt, a base assembly having a base panel opposite the roof panel and having a left and right base plate, a door panel, a front panel opposite the door panel, and a pair of side panels, where the door panel and front panel are hingedly connected to the roof panel to form a roof assembly and the side panels are hingedly connected to the base panel to form a base assembly. The roof assembly is positioned relative to the base assembly such that the left skirt is proximate the left base plate and the right skirt is proximate the right base plate when the container is in the folded condition. When five shipping containers are folded and stacked on top of each other, the assembly has a cumulative height approximately equal to a height of a single erect (9' 6" High Cube) shipping container. For a standard 8' High container, four folded shipping containers will fit in the vertical height.

In yet another embodiment of the present invention, a stacked container assembly is provided comprising plurality of intermodal shipping containers, where each container has a roof assembly with a left skirt and a right skirt extending perpendicular from a roof panel, a base assembly having a left base plate and a right base plate extending perpendicular to a base panel, the left and right base plates extending towards the left and right skirt, respectively. A door panel and an opposing front panel are hingedly connected to the roof panel while the side panels are hingedly connected to the base panel. The stacked container assembly is configured such that when the plurality of intermodal shipping containers are in a folded condition and stacked vertically, the base panel of the container arranged above an adjacent container is proximate the roof panel of the adjacent container.

It is an object of the present invention is to provide a novel, foldable, enclosed shipping container where the shipping container consumes less space when in the folded state compared to collapsible containers of the prior art.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The present invention discloses a system for improving the foldable nature of a shipping container and improved transport of said folded containers. A discussion of the present invention follows and relates to FIGS. 1-11.

Figure 1:
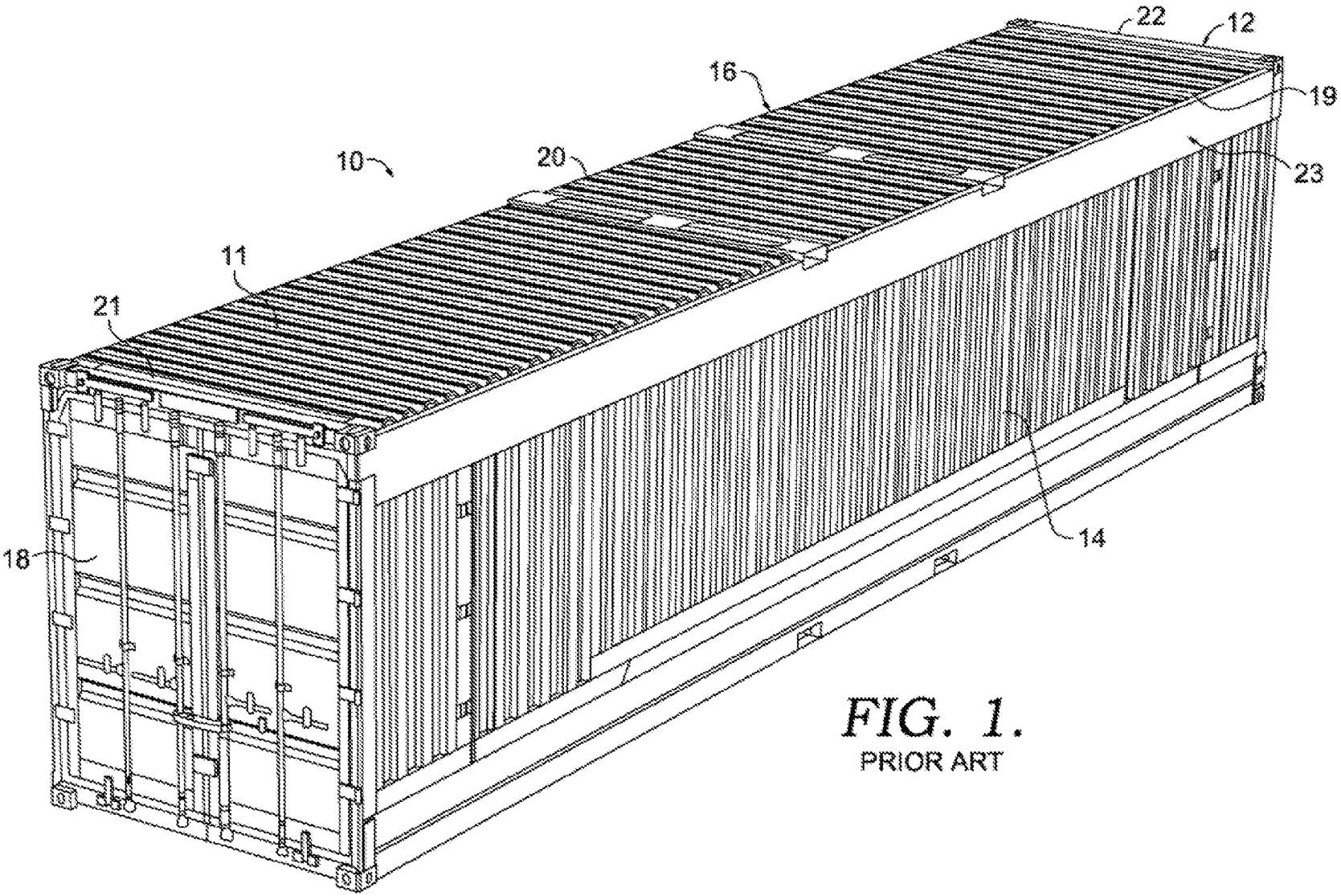
FIG. 1. PRIOR ART
FIG. 1 is a perspective view of a container of the prior art.
Figure 2:
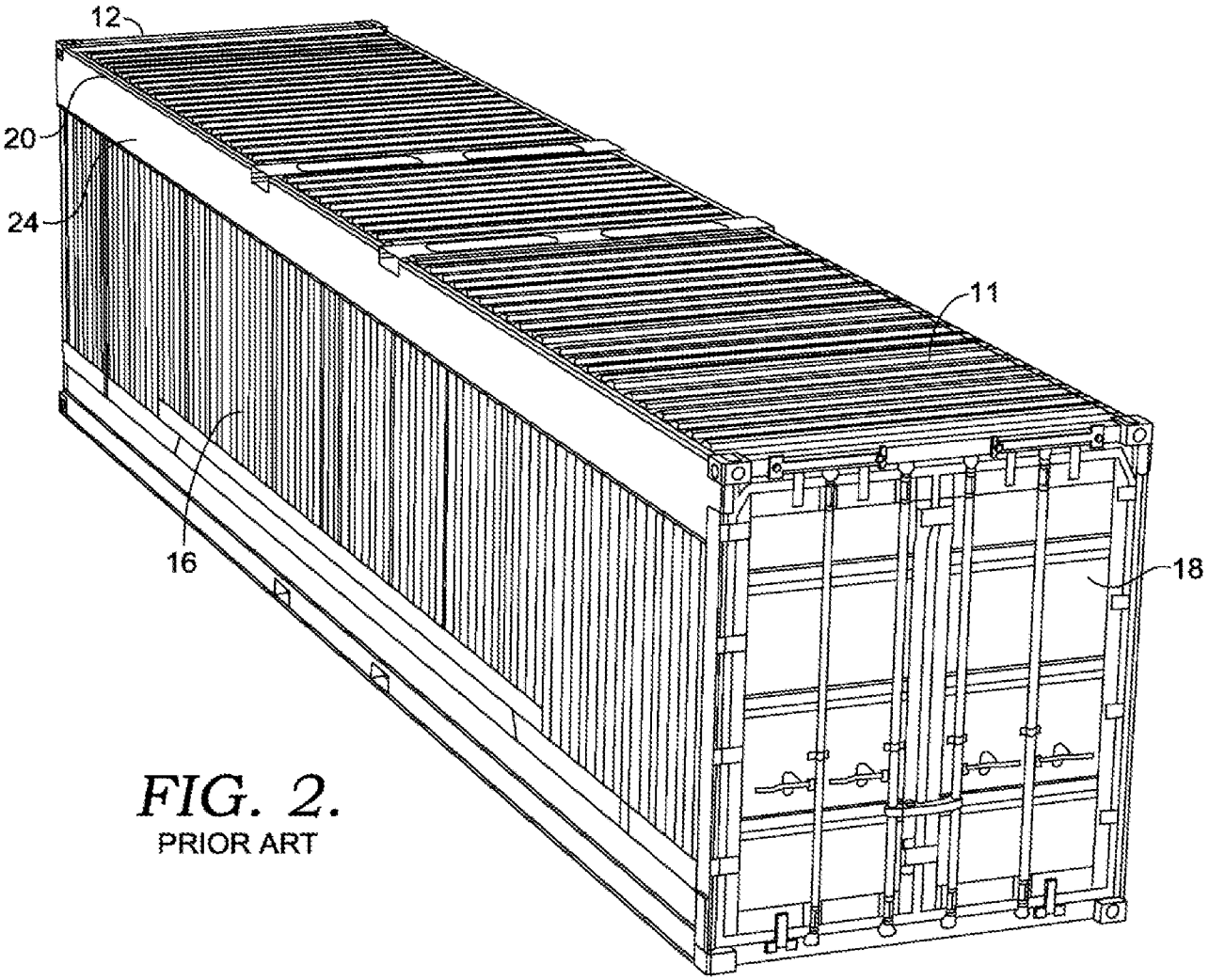
FIG. 2. PRIOR ART
FIG. 2 is an alternate perspective view of the container of FIG. 1.
Figure 3:
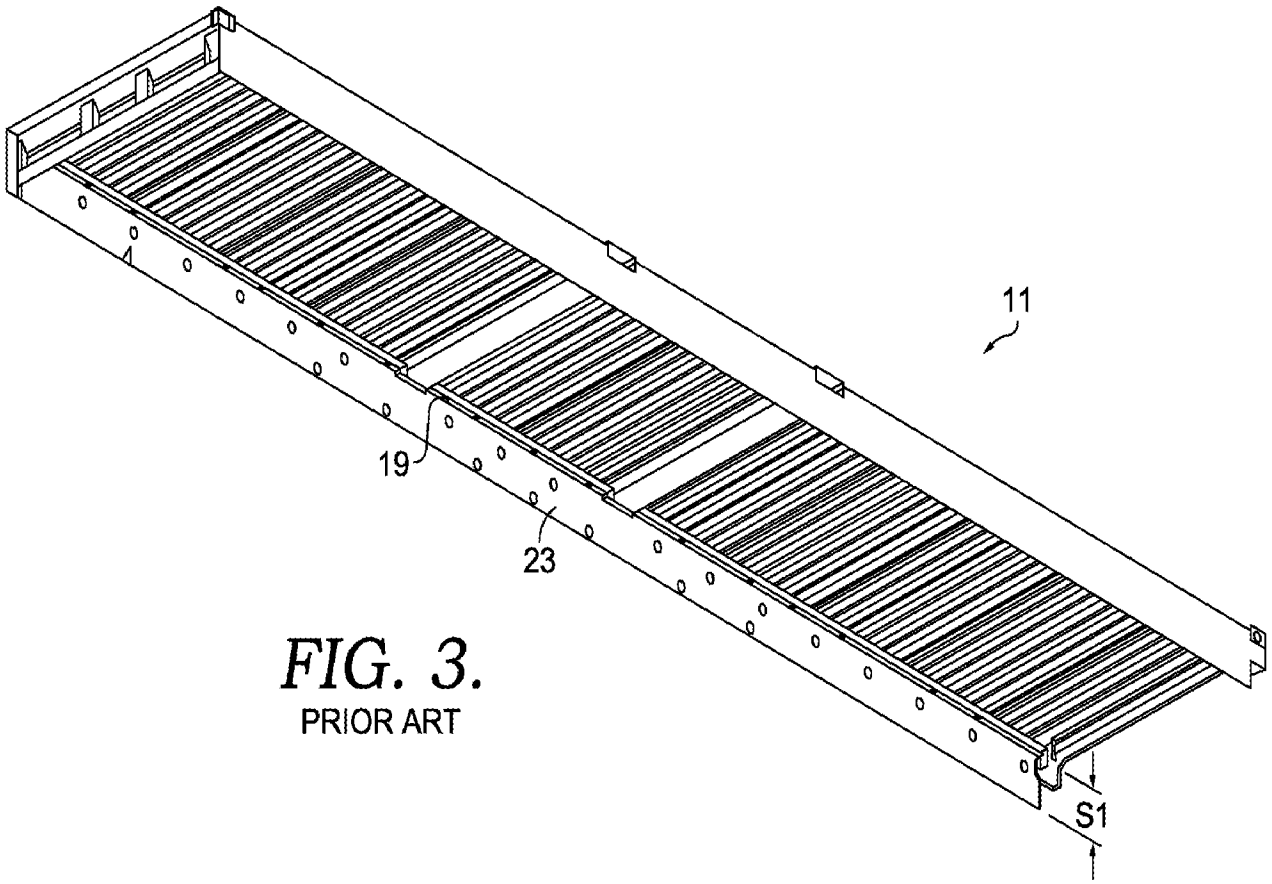
FIG. 3. PRIOR ART
FIG. 3 is a perspective view of the roof panel of the container of FIG. 1.
Figure 4:
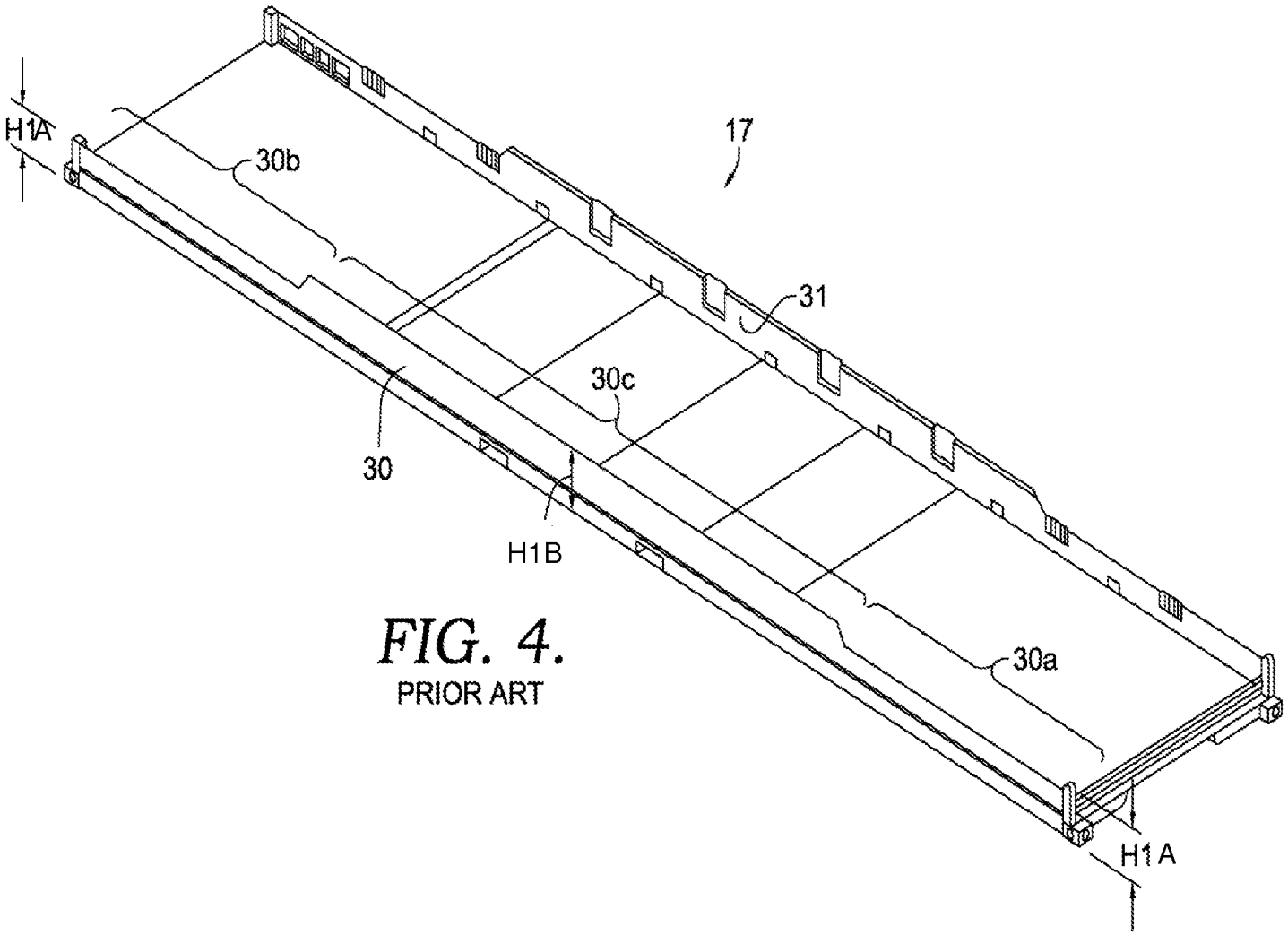
FIG. 4. PRIOR ART
FIG. 4 is a perspective view of the base panel of the container of FIG. 1.

Referring initially to FIGS. 1-7, multiple views of a foldable container 10 in accordance with a prior art container are provided. One such example is co-pending U.S. patent application Ser. No. 13/815,638, hereby incorporated by reference. FIGS. 1 and 2 depict perspective views of a foldable container 10 of the prior art. The foldable container 10 comprises a roof panel 11, an opposing base panel 17, a door panel 18, an opposing front panel 12, a right side panel 14, and an opposing left side panel 16. Collectively, the right side panel 14 and the left side panel 16 may be referred to herein as the "side panels," or individually either may be referred to herein as a "side panel." FIG. 3 depicts a perspective view of the roof panel 11 while FIG. 4 depicts a perspective view of a base panel 17.

Referring back to FIGS. 1-3, the roof panel 11 includes a right roof edge 19, an opposing left roof edge 20, a door roof edge 21, and a front roof edge 22. Extending from the right roof edge 19 is a right skirt 23 and extending from the opposing left roof edge 20 is a left skirt 24. The foldable container 10 has left and right skirt heights S1 of approximately 18.5 inches. Each of the skirts 23 and 24 extend generally perpendicular relative to the roof panel 11.

Referring to FIGS. 1, 2 and 4, the base panel 17 has a left base plate 30 and an opposing and parallel right base plate 31. The pair of base plates 30 and 31 extend vertically from the base panel 17. More specifically, the left base plate 30 has a first portion 30*a* and a second portion 30*b*, each of which extend a base height H1A of approximately eight inches. The left base plate 30 has a third portion 30*c* located between the first and second portions 30*a* and 30*b*. The third portion 30*c* has a base height H1B of approximately twelve inches. The right base plate 31 has similar portions and corresponding heights to those of the left base plate 30.

Figure 5:
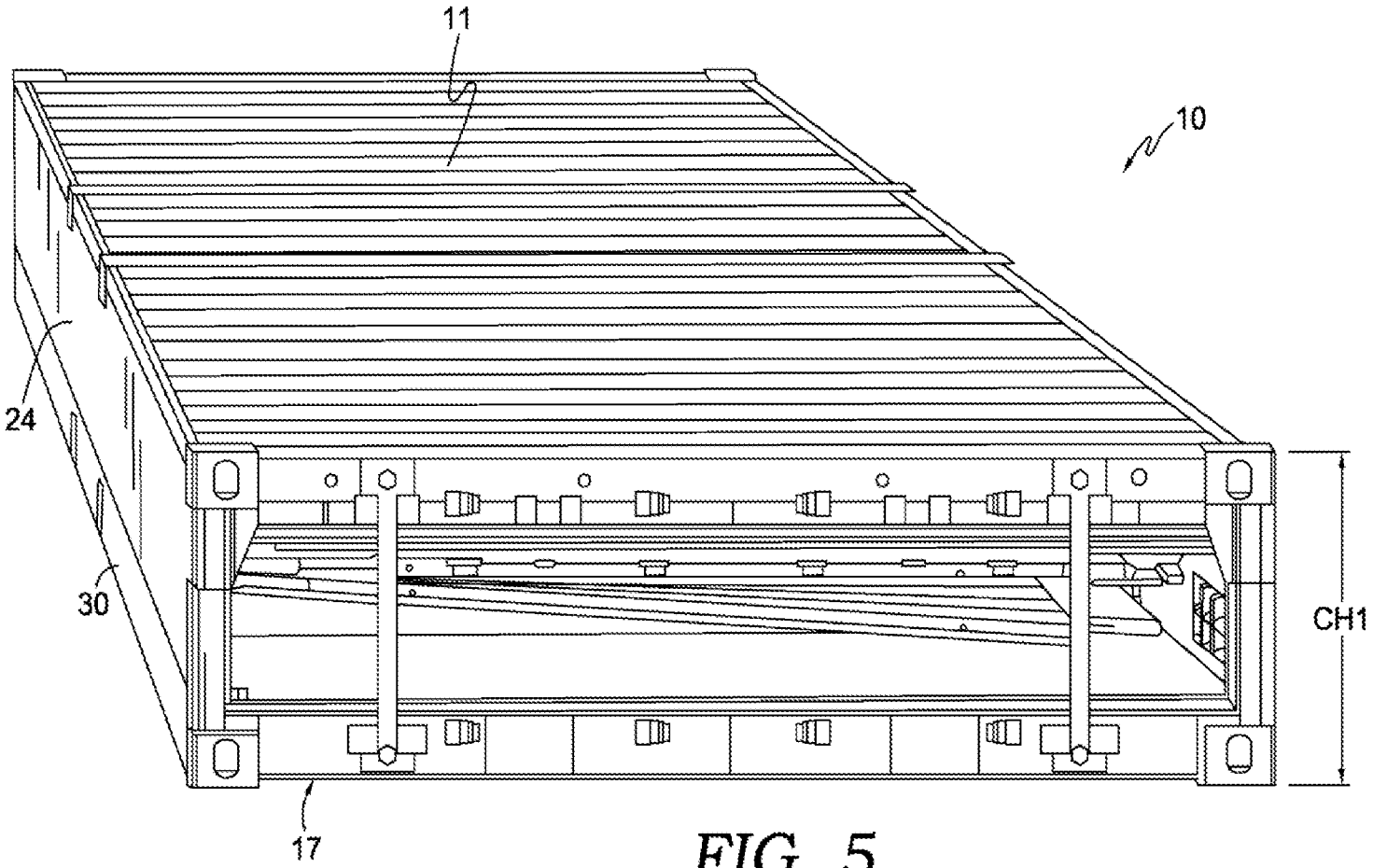
FIG. 5. PRIOR ART
FIG. 5 is a perspective view of the container of FIG. 1 in a collapsed state.
Figure 6:
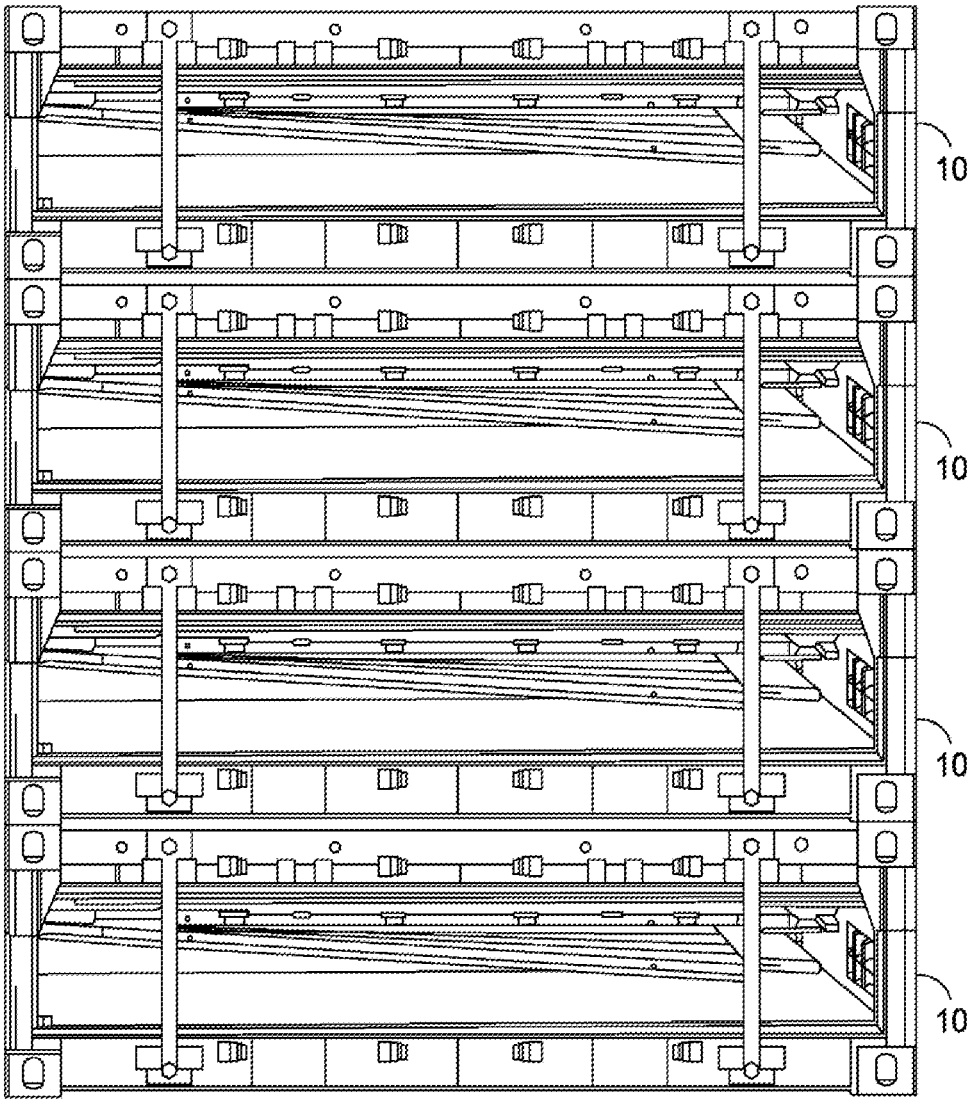
FIG. 6. PRIOR ART
FIG. 6 is an elevation view of a stacked assembly of containers of the prior art.

Referring now to FIG. 5, a perspective view of the foldable container 10 is shown with the container 10 in the folded condition. In this position, the skirts 23 and 24 extend so as to be positioned adjacent the corresponding base plate 30 and 31. Sandwiched between the roof panel 11 and base panel 17 are the side panels 14 and 16, the door panel 18 and the front panel 12. Given the geometry discussed above, when the foldable container 10 is in the folded condition, the container has a collapsed height CH 1 of approximately 724 mm. As one skilled in the art of shipping containers understands, a typical shipping container for use in cargo transport by road, rail or freighter, has an erect height of approximately 2896 mm (9 feet, 6 inches) for containers classified as High Cube Configurations. Therefore, when the foldable container 10 is in the collapsed condition, as shown in FIG. 5, four foldable containers 10 may be stacked in a vertical arrangement so as to have a combined vertical height of approximately 2896 mm (9 feet, 6 inches), equivalent to the height a standard high cube container, as shown in FIG. 6. As such, the foldable container 10 of the prior art can collapse such that four containers may be transported/returned to a shipper in the space typically occupied by a single erect container.

Figure 7:
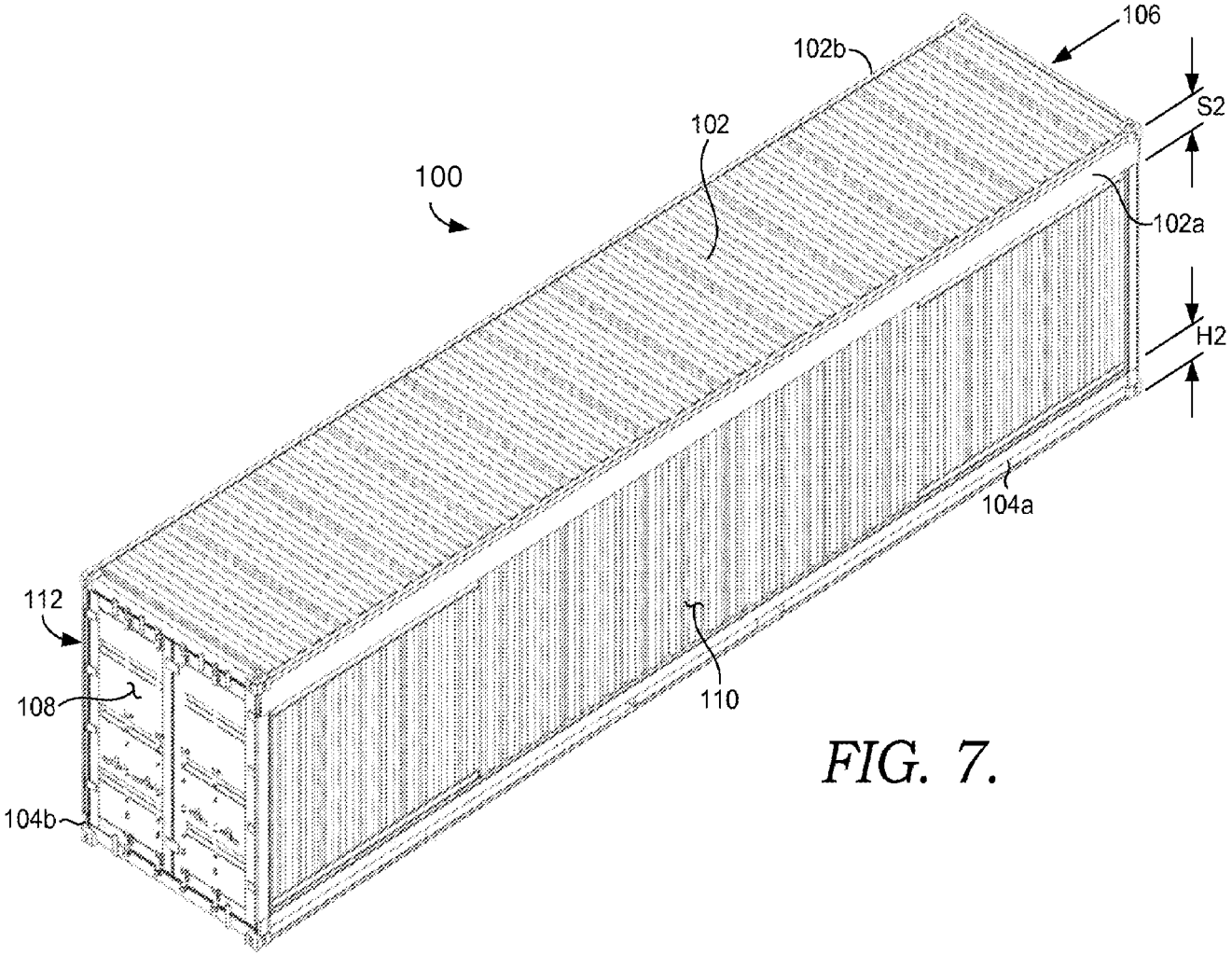
FIG. 7 is a perspective view of a foldable container in accordance with an embodiment of the present invention.

The present invention is shown in and will be discussed in detail with respect to FIGS. 7-11. Referring initially to FIG. 7, a foldable container 100 is shown in a perspective view. The foldable container 100 comprises a roof assembly having a roof panel 102, a front panel 106 and an opposing door panel 108. A base assembly has a base panel 104 opposite the roof panel 102, and a pair of side panels 110 and 112. The roof panel 102 is oriented parallel to the base panel 104 while the front panel 106 is parallel to the door panel 108. The door panel 108 may be comprised of one or more door sections for providing access to the inside of the container 100. As used herein, the term "panel" can comprise a single section or in the alternative can be comprised of multiple sections secured together by an acceptable process, such as welded together to form a weldment.

The pair of side panels 110 and 112 are oriented to be parallel to each other and perpendicular to the roof panel 102, the base panel 104, the front panel 106, and the door panel 108. More specifically, the foldable container 100 comprises a left side panel 110 and an opposing right side panel 112.

The roof assembly 102 further comprises a left skirt 102*a* and a right skirt 102*b*, where the left skirt 102*a* and the right skirt 102*b* extend perpendicular from the roof panel 102*a* distance S2 towards the base panel 104. For an embodiment of the present invention the height S2 of the left skirt 102*a* and the right skirt 102*b* is approximately fourteen inches, a significantly different design than containers of the prior art.

The base assembly 104 further comprises a left base plate 104*a* and a right base plate 104*b*, where the left base plate 104*a* and the right base plate 104*b* extend perpendicular to the base panel 104 a distance H2. For an embodiment of the present invention, the height H2 of the left base plate 104*a* and right base plate 104*b* is uniform at approximately eleven inches and is a c-channel type beam, and again less than prior art designs. A c-channel beam construction provides the necessary structural stability for a container while permitting the height of the base plates to be reduced. A smaller base plate height allows the container 100 to fold to a smaller vertical height compared to the prior art by allowing the roof assembly to collapse further towards the base assembly.

Figure 8:
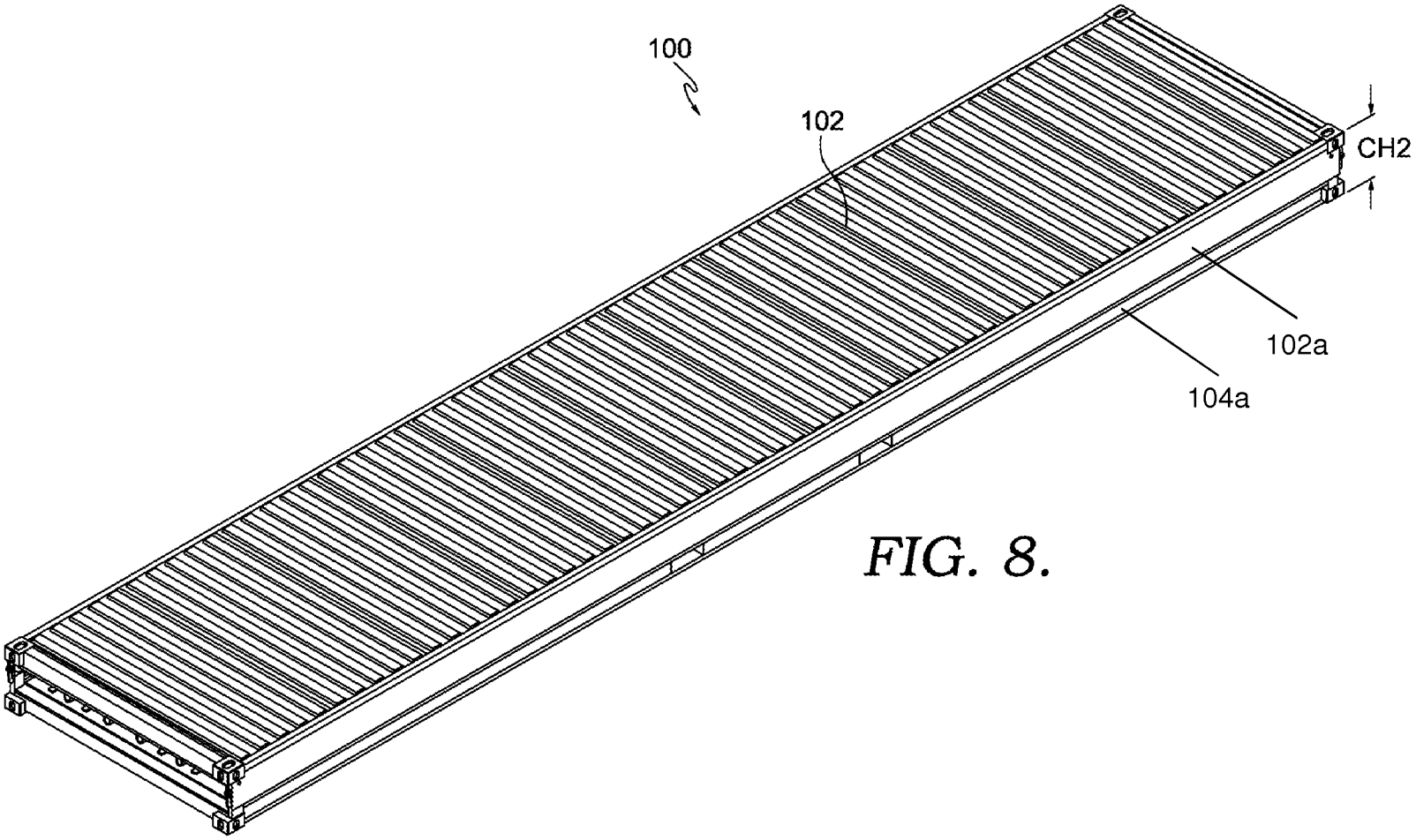
FIG. 8 is a perspective view of the foldable container of FIG. 7 in a folded condition in accordance with an embodiment of the present invention.

The front panel 106, door panel 108, left side panel 110 and right side panel 112 are each capable of rotating to a folded position so as to permit the foldable container 100 to fold into a storage condition, as shown in FIG. 8. In the storage condition shown in FIG. 8, the side panels 110 and 112 fold in towards the base panel 104, the door panel 108 and front panel 106 fold towards the roof panel 102 thereby permitting the roof panel 102 to be lowered down towards the base panel 104. The door panel 108, front panel 106 and side panels 110 and 112 are positioned between and generally parallel to the roof panel 102 and base panel 104. As a result of the geometry of the skirts 102*a* and 102*b* and the geometry of the base plates 104*a* and 104*b*, the roof panel 102 and base panel 104 are able to be positioned in closer proximity when the foldable container 100 is in the folded/storage condition.

The present invention provides an alternate internal beam geometry for the container 100 that is shorter than prior designs. The present invention also removes compression springs of the prior art container 10. The cables that compressed the springs of the prior art container 10 created an interference that limited the height of the side panels 14 and 16, thereby making the top skirt 23 and 24 taller. As a result, the taller top skirt 23 and 24 passes by a base beam so as to overlap the two beams for sealing and resulted in a taller collapsed container than provided by the present invention.

In the folded/storage condition shown in FIG. 8, the left skirt 102*a* is in close proximity to the left base plate 104*a* and the right skirt 102*b* is in close proximity to the right base plate 104*b*. As such, the foldable container 100 has a folded height CH2 of approximately 579 mm. The folded height CH2 of the foldable container 100 is approximately 20% smaller than the prior art foldable container 10 in FIGS. 1-6. The present container 100 has its overall folded height reduced by over five inches compared to prior art containers. In a multi-container vertical stack, a savings of over five inches per container allows for an additional container to be stacked in the space saved compared to prior art folding containers.

Figure 9:
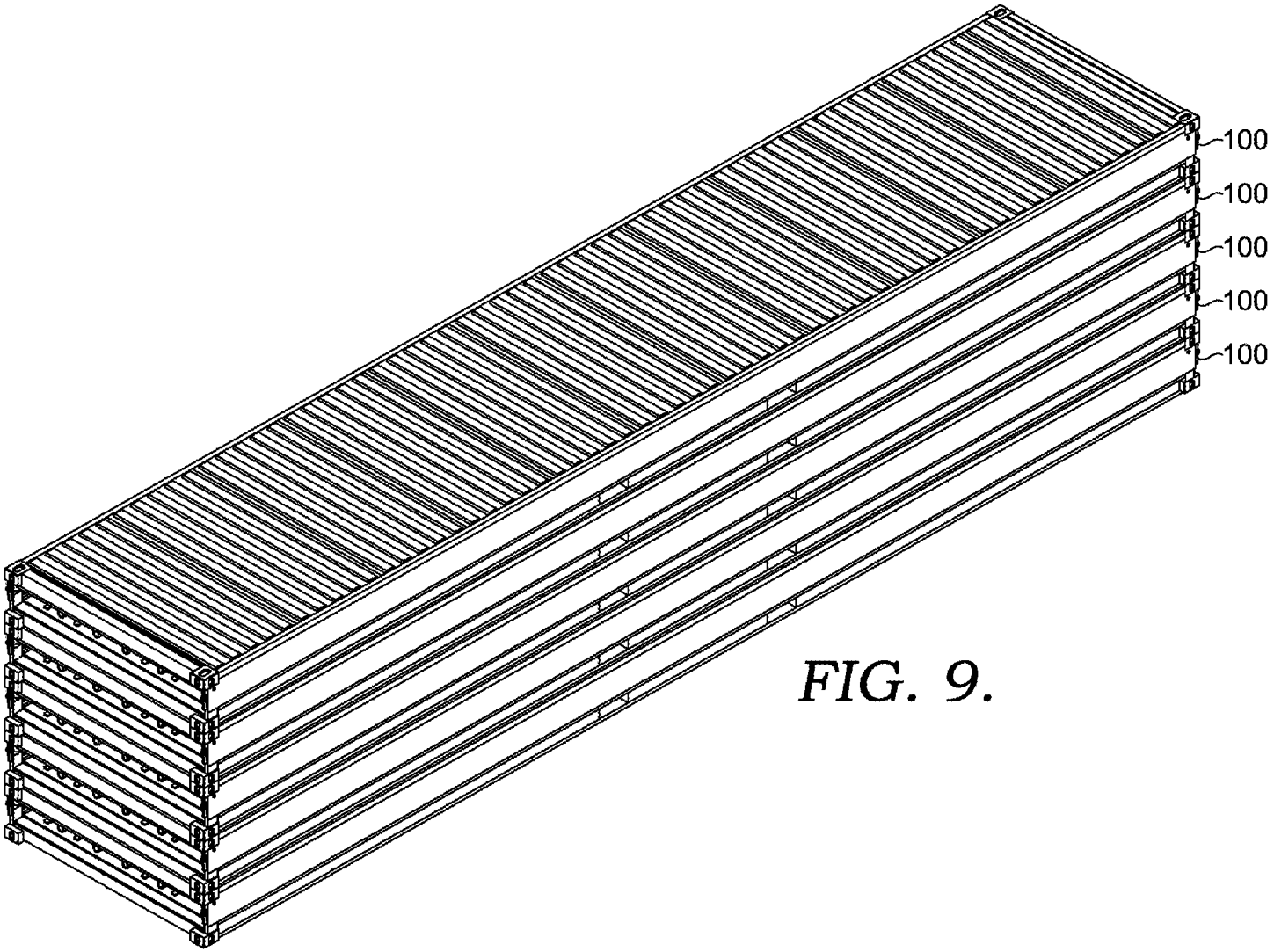
FIG. 9 is a perspective view of a stacked assembly of containers in accordance with an embodiment of the present invention.
Figure 10:
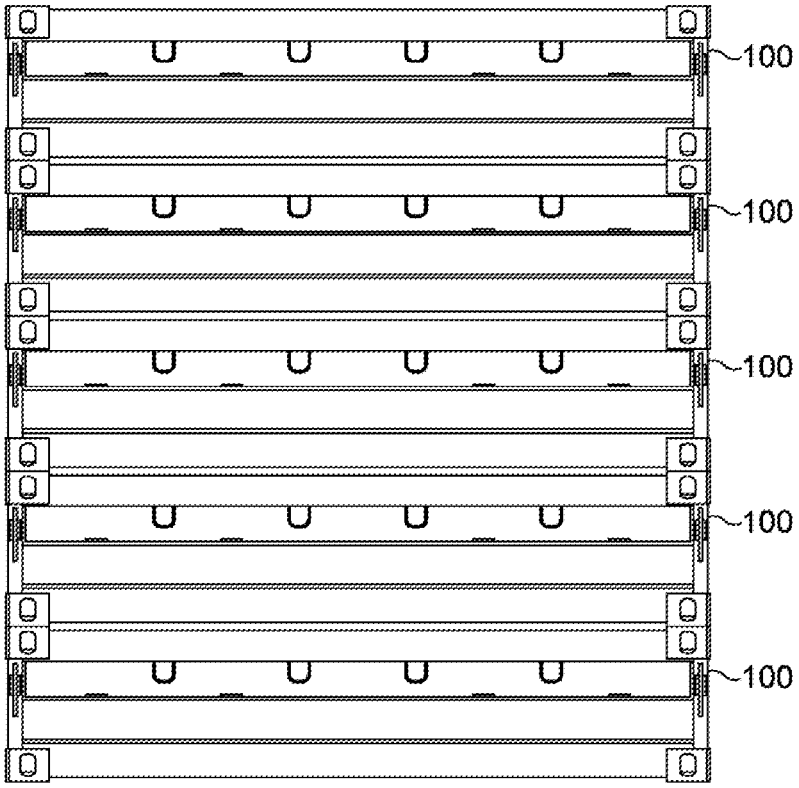
FIG. 10 is an elevation view of the stacked assembly of containers of FIG. 9 in accordance with an embodiment of the present invention.
Figure 11:
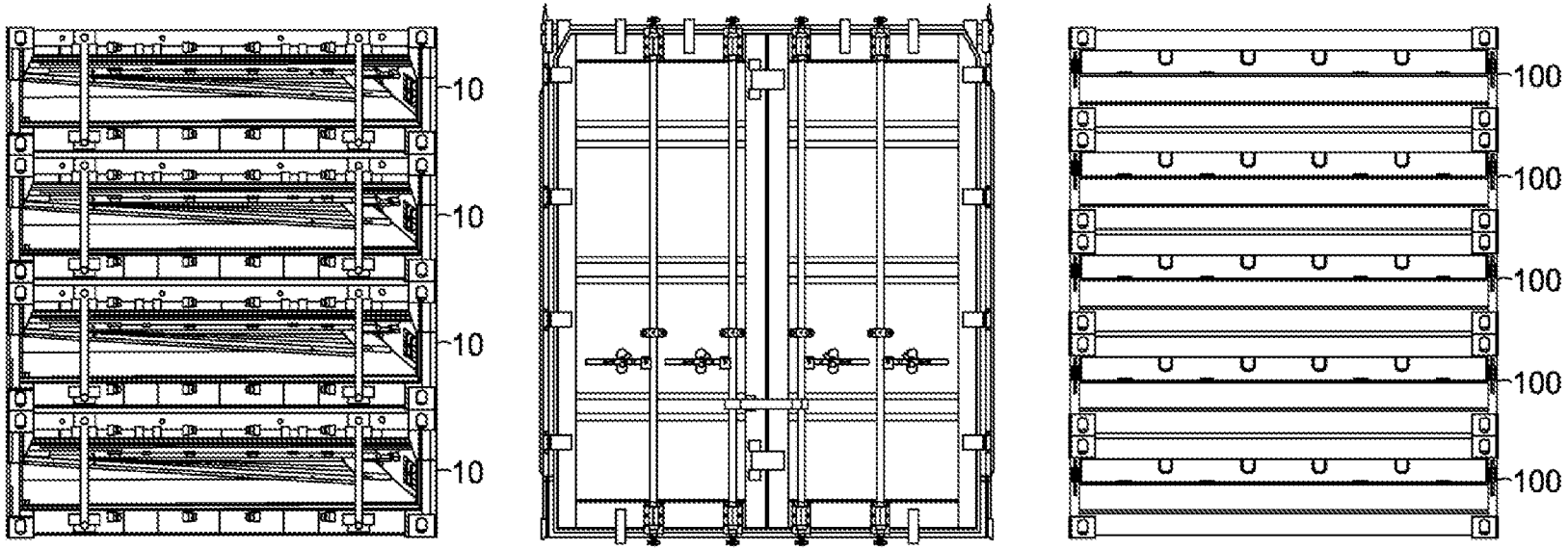
FIG. 11 is an elevation view comparing a stacked assembly of prior art containers, a stacked assembly of the present invention, and an erect shipping container.

The foldable container 100 of the present invention is capable of being stacked vertically multiple units high when not in use, as shown in FIG. 9. While any number of foldable containers 100 can be stacked and secured together when not in use, five of the foldable containers 100 can be stacked vertically and secured together in the space of a single standard 9' 6" High Cube erect shipping container. Each of the foldable containers 100 have a folded height CH2 of approximately 579 mm. When stacked together, the five foldable containers 100 have a cumulative stacked height of approximately 2896 mm. As discussed above, the height of a standard, erect shipping container is also approximately 2896 mm (or 9 feet, 6 inches). Accordingly, through the present invention, five foldable containers 100 now occupy the space of a single erect container or four foldable containers 10 in accordance with the prior art. As a result, 20% greater number of containers can be directed to a shipping source over the quantity of prior art foldable containers 10. The exact height may vary slightly in order to account for the necessary interlock spacing between stacked containers and manufacturing tolerances as large unit manufacturing involving sheet metal can have some dimensional variations.

When the foldable containers 100 are stacked in vertical relationship, a stacked container assembly comprises a plurality of shipping containers where the base panel of one container is stacked adjacent the roof panel of an adjacent container. The stacked containers are then secured together with one or more removable fasteners.

The foldable container 100 of the present invention is fabricated from materials capable of withstanding a variety of weather elements and operating conditions. At least the exterior surfaces of the roof panel 102, base panel 104, front panel 106, door panel 108, side panels 110 and 112 are fabricated from corrugated metal, such as CorTen® steel. For example, CorTen® A, also known as A588, is an industry standard acceptable material as this material provides excellent corrosion resistance. This material capability is necessary given the harsh weather conditions experienced by the foldable container, including but not limited to salt water, sea air, rain, snow, and extreme heat and cold.

The exterior surfaces of the foldable container 100 can then be assembled to any internal structure such as a series of support beams by a series of springs, pins, fasteners, welds or other type securing means. Internal walls of the foldable container 100 can be corrugated metal or can be lined with other materials as desired by the owner/operator of the foldable container 100.

The present invention is applicable to a variety of standard intermodal shipping containers. For example, the folding and stacking configuration disclosed herein can be applied to containers of various lengths including, but not limited to, containers of 10 feet, 20 feet, 24 feet, 40 feet, 48 feet, and 53 feet in length.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A vertically-stacked assembly of folded shipping containers, each container comprising:

a roof assembly having a roof panel with a left skirt and a right skirt extending perpendicular from the roof panel, the left skirt and right skirt each extending a distance S2;

a base assembly having a base panel with a left base plate and a right base plate extending perpendicular from the base panel, the left base plate and the right base plate each extending a height H2; and, a door panel, an opposing front panel and a pair of side panels, the door panel and the front panel hingedly connected to the roof panel, the side panels hingedly connected to the base panel;

wherein the distance S2 is greater than the height H2 and the roof panel is positioned relative to the base panel such that the left skirt is positioned proximate the left base plate and the right skirt is positioned proximate the right base plate.

2. The vertically-stacked assembly of claim 1, wherein the assembly of the folded shipping containers is secured together through the base panel and the roof panel of adjacent shipping containers.

3. The vertically-stacked assembly of claim 2, wherein the folded shipping containers are secured together with a plurality of removable fasteners.

4. The vertically-stacked assembly of claim 1, wherein the stacked assembly comprises five containers.

5. The vertically-stacked assembly of claim 1, wherein the stacked assembly comprises five shipping containers, where each container has a folded height of 579 mm.

6. The vertically-stacked assembly of claim 5, wherein the assembly of folded shipping containers have a height of 2896 mm.

7. The vertically-stacked assembly of claim 6, wherein the door panel, the front panel, and the side panels are folded so as to be generally parallel to the roof panel and the base panel.

8. A stacked container assembly comprising:

a plurality of intermodal shipping containers, each container having a roof assembly with a roof panel, a left skirt and a right skirt extending perpendicular from the roof panel, a base assembly with a base panel having a left base plate and a right base plate extending perpendicular to the base panel, the left base plate and the right base plate extending towards the left skirt and right skirt, respectively, a door panel, an opposing front panel, and a pair of side panels, the door panel and the front panel hingedly connected to the roof panel and the side panels hingedly connected to the base panel; and one or more securing mechanisms for securing one or more of the plurality of intermodal shipping containers together in a stacked arrangement;

wherein the stacked container assembly is configured such that when the plurality of intermodal shipping containers are in a folded condition, a second container is stacked onto a first container such that the base panel of the second container is proximate the roof panel of the first container, a third container is stacked onto the second container such that the base panel of the third container is proximate the roof panel of the second container, a fourth container is stacked onto the third container such that the base panel of the fourth container is proximate the roof panel of the third container, and a fifth container is stacked onto the fourth container such that the base panel of the fifth container is proximate the roof of the fourth container.

9. The stacked container assembly of claim 8, wherein the left skirt and right skirt are positioned proximate the left base plate and right base plate, respectively, for each of the containers in the folded condition.

10. The stacked container assembly of claim 9, wherein the left skirt and the right skirt and the left base plate and the right base plate do not fold when the intermodal shipping containers are in the folded condition.

11. The stacked container assembly of claim 8 having a vertical height equal to that of a single, intermodal shipping container in a erect position.

12. The stacked container assembly of claim 8 having a cumulative weight equal to that of a single, erect container loaded with a maximum allowable weight.

* * * * *